US011201432B2

(12) United States Patent
Yamada et al.

(10) Patent No.: US 11,201,432 B2
(45) Date of Patent: Dec. 14, 2021

(54) CONNECTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Yusuke Yamada, Yokkaichi (JP); Hirotaka Baba, Yokkaichi (JP); Junichi Mukuno, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/959,181

(22) PCT Filed: Jan. 15, 2019

(86) PCT No.: PCT/JP2019/000858
§ 371 (c)(1),
(2) Date: Jun. 30, 2020

(87) PCT Pub. No.: WO2019/142762
PCT Pub. Date: Jul. 25, 2019

(65) Prior Publication Data

US 2020/0343668 A1 Oct. 29, 2020

(30) Foreign Application Priority Data

Jan. 16, 2018 (JP) ..... JP2018-004903

(51) Int. Cl.
*H01R 13/516* (2006.01)
*H01R 13/52* (2006.01)

(52) U.S. Cl.
CPC ..... *H01R 13/5208* (2013.01); *H01R 13/516* (2013.01)

(58) Field of Classification Search
CPC ..... H01R 13/5208; H01R 13/516; H01R 13/512; H01R 13/504; H01R 13/5812; H01R 13/5202
See application file for complete search history.

(56) References Cited

U.S. PATENT DOCUMENTS 7,029,328 B1 * 4/2006 Mckenzie ..... H01R 13/5221 439/587
2012/0270444 A1 * 10/2012 Kawamura ..... H01R 13/5205 439/607.44

(Continued)

FOREIGN PATENT DOCUMENTS

JP 2012-199051 A 10/2012
JP 2014-029780 A 2/2014

(Continued)

OTHER PUBLICATIONS

Mar. 5, 2019 International Search Report issued in Internationak Patent Application No. PCT/JP2019/000858.

*Primary Examiner* — Truc T Nguyen
(74) *Attorney, Agent, or Firm* — Oliff PLC

(57) ABSTRACT

A connector that includes a wire; a housing having a wire draw-out surface, the wire being drawn out from the wire draw-out surface; a shield disposed outside the housing; a first water stop sandwiched between and held in contact with the housing and the shield; and a second water stop sandwiched between and held in contact with the wire drawn out from the wire draw-out surface and the shield, the shield (Continued)

including a water stop holder that holds the second water stop between the wire draw-out surface and the water stop holder.

3 Claims, 4 Drawing Sheets

(56) References Cited

U.S. PATENT DOCUMENTS

| | | | | |
|---|---|---|---|---|
| 2014/0011400 | A1* | 1/2014 | Shiga | H01R 13/5208 439/587 |
| 2014/0011401 | A1 | 1/2014 | Endo et al. | |
| 2014/0038459 | A1* | 2/2014 | Kobayashi | H01R 13/6581 439/607.41 |
| 2014/0120767 | A1* | 5/2014 | Itsuki | H01R 13/5202 439/587 |
| 2014/0209377 | A1 | 7/2014 | Wang | |
| 2015/0140851 | A1 | 5/2015 | Wang | |
| 2015/0357748 | A1* | 12/2015 | Ohmori | H01R 9/0512 439/578 |
| 2016/0276776 | A1* | 9/2016 | Motohashi | H01R 13/5812 |
| 2018/0048081 | A1* | 2/2018 | Komori | H01R 9/11 |
| 2019/0221963 | A1* | 7/2019 | Linseder | H01R 13/5205 |

FOREIGN PATENT DOCUMENTS

| | | | |
|---|---|---|---|
| JP | 2014-146435 | A | 8/2014 |
| JP | 2016-119186 | A | 6/2016 |
| JP | 2017-157417 | A | 9/2017 |
| JP | 2017-162594 | A | 9/2017 |

* cited by examiner

CONNECTOR

BACKGROUND

A technique disclosed in this specification relates to a connector.

Conventionally, a connector with a housing having a waterproof structure is, for example, known from Japanese Unexamined Patent Publication No. 2017-162594. In this waterproof connector, connected parts of wires and terminals are embedded in the housing and a shield shell made of metal covers the housing.

A fitting portion mountable on a case is provided on a front end part of the shield shell, and a seal ring is mounted on the outer peripheral surface of the fitting portion. If the fitting portion is fit into the case, the seal ring is held in close contact with the outer peripheral surface of the fitting portion and the case.

A plurality of rubber plug accommodating portions penetrating in a front-rear direction are provided in a rear end part inside the shield shell. An individual rubber plug to be held in close contact with the outer peripheral surface of the wire and the inner peripheral surface of the rubber plug accommodating portion and a rubber plug presser for retaining the individual rubber plug by being fit behind the individual rubber plug are accommodated in each rubber plug accommodating portion. Specifically, a waterproof region is configured in the shield shell by the seal ring and the individual rubber plugs.

SUMMARY

However, since the rubber plug pressers need to be accommodated in the rubber plug accommodating portions of the shield shell in this technique, the connector is enlarged.

A connector according to the technique disclosed in this specification includes a wire; a housing having a wire draw-out surface, the wire being drawn out from the wire draw-out surface; a shield disposed outside the housing; a first water stop sandwiched between and held in contact with the housing and the shield; and a second water stop sandwiched between and held in contact with the wire drawn out from the wire draw-out surface and the shield, the shield including a water stop holder that holds the second water stop between the wire draw-out surface and the water stop holder.a According to this configuration, water is stopped between the housing and the shield by the first water stop and between the wire and the shield by the second water stop, whereby the wire draw-out surface of the housing is within a water stop region. Thus, the intrusion of water and the like into the housing can be prevented. Further, since the second water stop is held between the wire draw-out surface and the water stop holder of the shield, a member for holding the second water stop needs not be separately provided and the connector can be reduced in size accordingly.

The following configurations are preferable as embodiments according to the technique disclosed in this specification.

(1) The wire includes a plurality of wires that are drawn out from the wire draw-out surface, the second water stop includes a plurality of through holes, one wire of the plurality of wires being inserted into each of the plurality of through holes, and the water stop holder includes a collective holder disposed to collectively surround the plurality of wires and an inter-wire holder disposed between respective wires of the plurality of wires.

In a configuration in which the second water stop is held between the wire draw-out surface and the collective holder, if the second water stop comes into contact with the collective holder, a part between the plurality of wires tends to be deformed to escape and protrude out from a proper position. According to the above configuration, since the second water stop is held also between the wire draw-out surface and the inter-wire holder, the second water stop can be held at the proper position.

(2) The wire and the housing are integrally formed by insert molding.

If the wire and the housing are integrally formed by insert molding, a clearance between the wire and the housing allows the intrusion of water and the like. Since the wire draw-out surface is disposed in the water stop region according to the above configuration, the intrusion of water and the like through the clearance between the wire and the housing can be prevented.

The connector according to the technique disclosed in this specification can be reduced in size by suppressing the number of components while preventing water intrusion into the housing.

DETAILED DESCRIPTION OF EMBODIMENTS

Embodiment

An embodiment is described with reference to FIGS. 1 to 3.

Figure 1A:
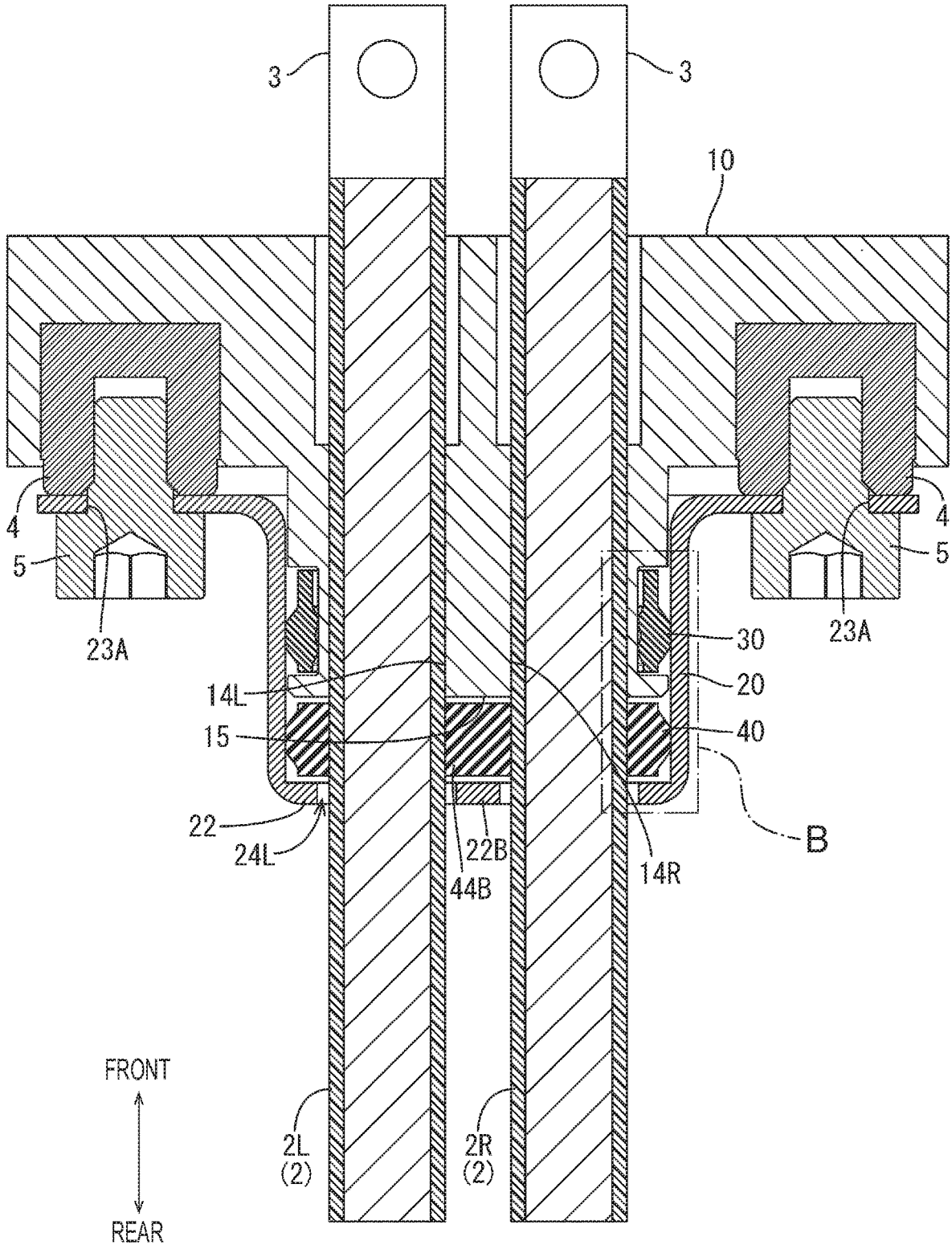
FIG. 1 is a longitudinal section of a connector according to an embodiment.

As shown in FIG. 1(A), a connector 1 of this embodiment is a waterproof connector mounted on one end of each of two wires 2L, 2R constituting a harness and used by being connected to an unillustrated device such as an inverter. As shown in FIG. 1(A), the connector 1 includes a housing 10, a shield bracket 20 (an example of a shield member/shield), a first water stop member 30 (first water stop) and a second water stop member 40 (second water stop). The wires 2L, 2R are disposed inside the housing 10 by insert molding, and a terminal fitting 3 to be connected to a device side is mounted on the one end of each of the wires 2L, 2R, and the other ends of the wires 2L, 2R are drawn out from a side where the shield bracket 20 is disposed. In the following description, the wires 2L, 2R may be referred to as wires 2. Further, a side where the terminal fittings 3 are connected to the wires 2 is referred to as a front side and a side where the wires 2 are drawn out from the housing 10 is referred to as a rear side below.

Figure 2:
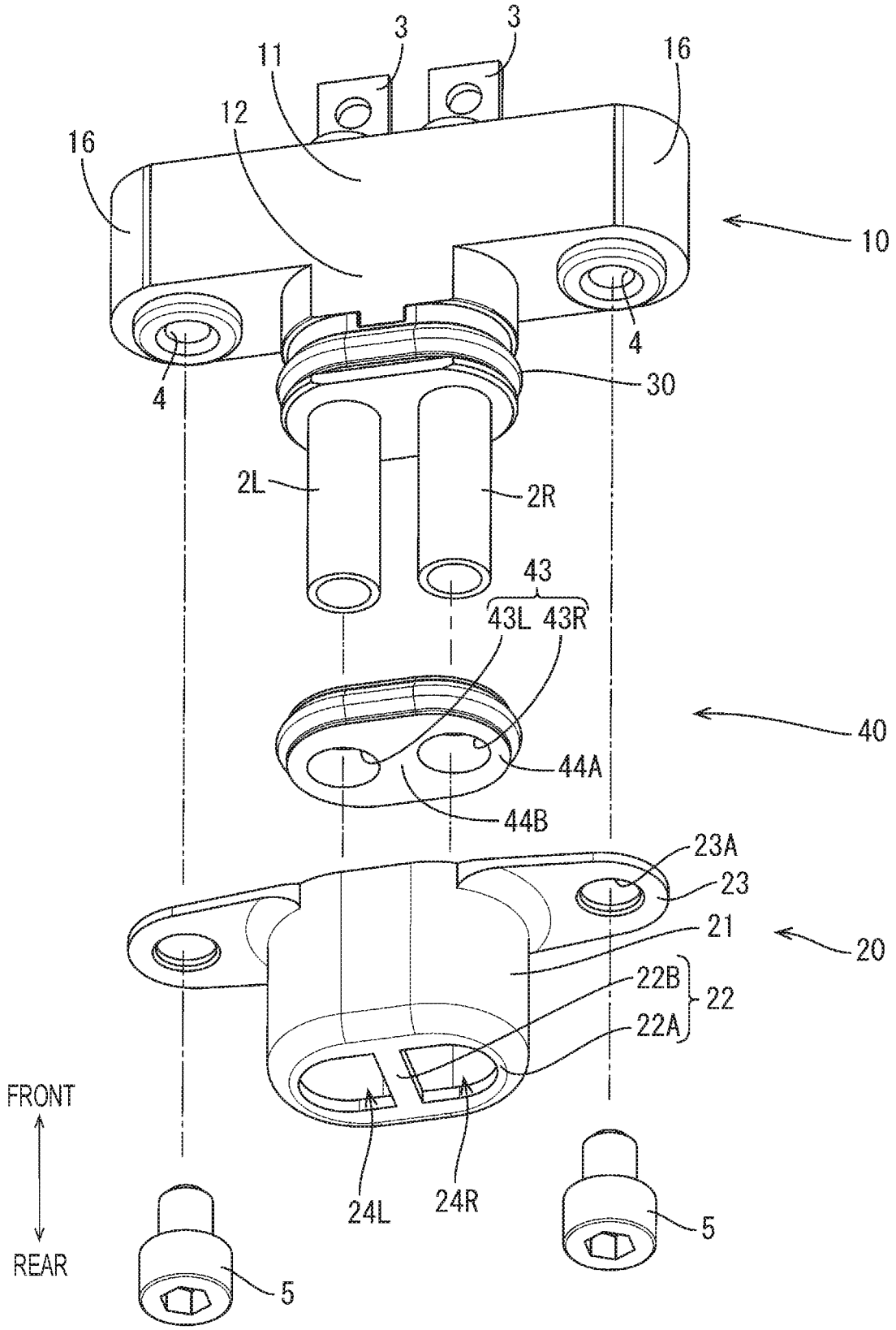
FIG. 2 is an exploded perspective view of the connector viewed from behind.

As shown in FIG. 2, the housing 10 includes a wire inserting portion 11 and a pair of mounting receiving portions 16 laterally projecting from the wire inserting portion 11. As shown in FIG. 3, a nut 4 is so embedded in each of the pair of mounting receiving portions 16 by insert molding as to be open rearward.

The wire inserting portion 11 is shaped to project further rearward than the mounting receiving portions 16, and this projecting part serves as a wire draw-out portion 12. The wire draw-out portion 12 has an elliptical shape when viewed from behind. As shown in FIG. 3, a part of an outer peripheral surface 12A of the wire draw-out portion 12 is recessed over the entire circumference to have a smaller diameter than other parts, thereby forming a fitting groove 13.

Figure 3:
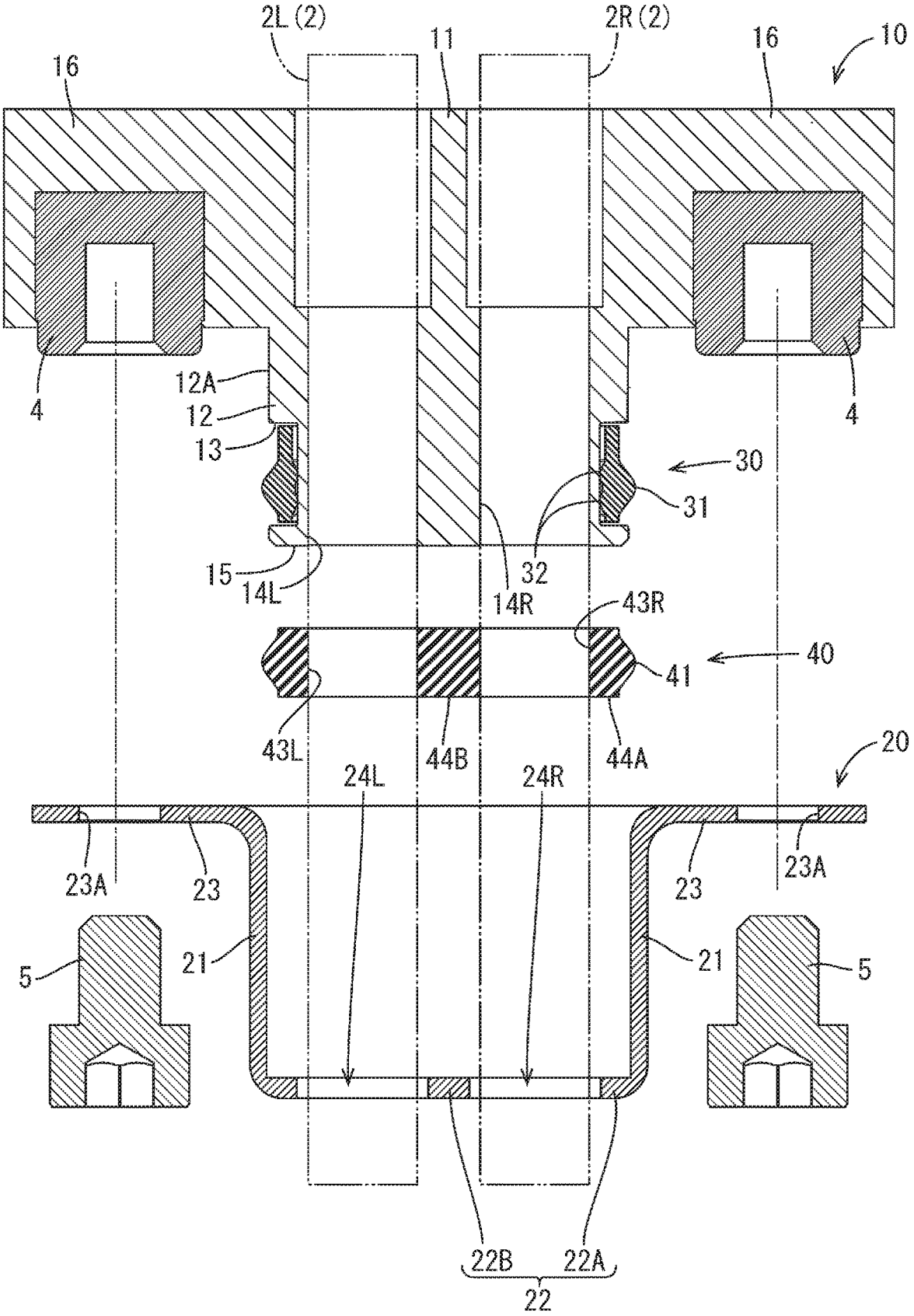
FIG. 3 is an exploded longitudinal section of the connector.

As shown in FIG. 3, the wire draw-out portion 12 is formed with two wire draw-out holes 14L, 14R, into each of which one of the wires 2L, 2R is insertable. Each wire draw-out hole 14L, 14R is a circular hole, extends in a front-rear direction in the wire inserting portion 11 and is open in a wire draw-out surface 15, which is the rear end of the wire draw-out portion 12. The wire draw-out surface 15 is a flat surface orthogonal to an axis extending in a draw-out direction of the wires 2. As indicated by imaginary lines in FIG. 3, the wires 2L, 2R are respectively inserted into the wire draw-out holes 14L, 14R and drawn out rearward from the wire draw-out surface 15.

The shield bracket 20 is a member made of a metal material and configured to stop water while covering and shielding the wire draw-out portion 12 of the housing 10. As shown in FIG. 2, the shield bracket 20 is composed of a water stop peripheral wall portion 21, a water stop holding portion 22 (water stop holder) and mounting portions 23.

As shown in FIGS. 2 and 3, the water stop peripheral wall portion 21 is a hollow tubular body having an elliptical shape when viewed from behind.

The water stop holding portion 22 is provided on the rear end of the water stop peripheral wall portion 21. The water stop holding portion 22 includes a collective holding portion 22A (collective holder) in the form of a frame extending in a diameter reducing direction from the rear end of the water stop peripheral wall portion 21, and an inter-wire holding portion 22B (inter-wire holder) provided along a lateral center line of the collective holding portion 22A. In other words, the collective holding portion 22A and the inter-wire holding portion 22B form two holding openings 24L, 24R as shown in FIG. 2.

As shown in FIG. 2, the mounting portions 23 are shaped to extend leftward and rightward from the front end of the water stop peripheral wall portion 21. One mounting hole 23A is provided to penetrate through each mounting portion 23 in the front-rear direction.

The first water stop member 30 is made of resiliently deformable synthetic resin and, as shown in FIG. 2, has an elliptical annular shape corresponding to the fitting groove 13 when viewed from behind. As shown in FIG. 3, two inner peripheral ribs 32 projecting in a diameter reducing direction are formed over the entire circumference on the inner peripheral surface of the first water stop member 30. One first outer peripheral rib 31 projecting in a diameter expanding direction is formed over the entire circumference on the outer peripheral surface of the first water stop member 30.

The second water stop member 40 is made of resiliently deformable synthetic resin and, as shown in FIG. 2, in the form of an elliptical plate corresponding to the wire draw-out surface 15 when viewed from behind. The front and rear surfaces of the second water stop member 40 are flat surfaces. The second water stop member 40 is formed with two circular through holes 43L, 43R penetrating from the front surface to the rear surface. As shown in FIG. 2, a region collectively surrounding the two through holes 43L, 43R is referred to as a collective surrounding portion 44A and a part between the through holes 43L, 43R is referred to as an inter-wire portion 44B below. One second outer peripheral rib 41 is formed to project in a diameter expanding direction over the entire circumference on the outer peripheral surface of the second water stop member 40.

Figure 1B:
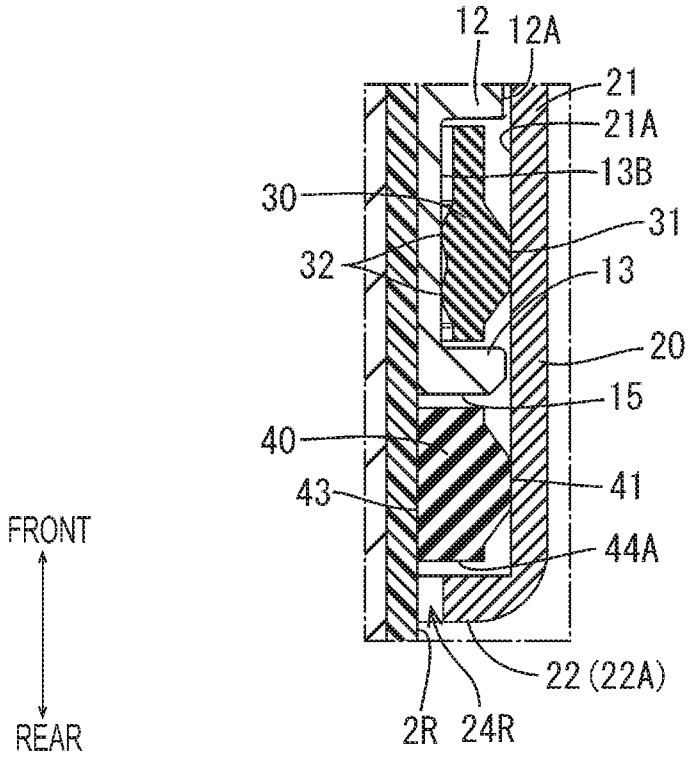

As shown in FIG. 2, the shield bracket 20 is mounted on the housing 10 by inserting bolts 5 into the respective mounting holes 23A and threadably engaging the bolts 5 with the nuts 4. In this state, as shown in FIG. 1(B), the water stop peripheral wall portion 21 covers the outer peripheral surface 12A of the wire draw-out portion 12 and the fitting groove 13 across a clearance defined between the outer peripheral surface 12A and the water stop peripheral wall portion 21. The water stop peripheral wall portion 21 is disposed to extend further rearward than the wire draw-out surface 15 and the water stop holding portion 22 is disposed on the rear end of the water stop peripheral wall portion 21 across a clearance defined between the wire draw-out surface 15 of the housing 10 and the water stop holding portion 22.

In this state, as shown in FIG. 1(B), the first water stop member 30 is fit into the fitting groove 13 and sandwiched between the wire draw-out portion 12 of the housing 10 and the water stop peripheral wall portion 21 of the shield bracket 20. Each inner peripheral rib 32 is held in close contact with a bottom surface 13B of the fitting groove 13 over the entire circumference and the outer peripheral rib 31 is held in close contact with an inner peripheral surface 21A of the water stop peripheral wall portion 21 over the entire circumference.

The wires 2L, 2R drawn out from the wire draw-out surface 15 are respectively press-fit into the through holes 43L, 43R of the second water stop member 40 and pulled out rearwardly and further extend rearward through the holding openings 24L, 24R of the shield bracket 20. In this way, the second water stop member 40 is sandwiched between the wires 2 and the water stop peripheral wall portion 21. The through holes 43L, 43R are respectively held in close contact with the wires 2L, 2R over the entire circumference and the second outer peripheral rib 41 is held in close contact with the water stop peripheral wall portion 21 over the entire circumference.

In this way, the wire draw-out surface 15 is surrounded over the entire circumference by the water stop peripheral wall portion 21 of the shield bracket 20 as shown in FIG. 1. The clearance between the water stop peripheral wall portion 21 and the outer peripheral surface 12A of the wire draw-out portion 12 is closed in a liquid-tight manner by the first water stop member 30 on a side forward of the wire draw-out surface 15, and a clearance between the water stop peripheral wall portion 21 and the wires 2 is closed in a liquid-tight manner by the second water stop member 40 on a side rearward of the wire draw-out surface 15. Specifically, the wire draw-out surface 15 is accommodated in a water stop region isolated from water and the like outside.

Further, the second water stop member 40 is disposed between the water stop holding portion 22 and the wire draw-out surface 15 such that the front surface thereof faces the wire draw-out surface 15 via the clearance and the rear surface thereof faces the water stop holding portion 22 via a clearance. A rearward displacement of the second water stop member 40 is restricted by the contact of the rear surface of the second water stop member 40 with the water stop holding portion 22 from front.

More particularly, the collectively holding portion 22A faces the collective surrounding portion 44A of the rear surface of the second water stop member 40 as shown in FIG. 1(B), and the inter-wire holding portion 22B faces the inter-wire portion 44B as shown in FIG. 1(A). In this way, the inter-wire holding portion 22B comes into contact with the inter-wire portion 44B to restrict any further deformation even if the collective surrounding portion 44A is pressed by the collective holding portion 22A and the inter-wire portion 44B is deformed to escape from a pressing force from the collective holding portion 22A.

By the above configuration, the connector 1 includes the housing 10 having the wire draw-out surface 15 from which the wires 2 are drawn out, the shield member (shield bracket 20) disposed outside the housing 10, the first water stop member 30 to be sandwiched between and held in close contact with the housing 10 and the shield member 20, and the second water stop member 40 to be sandwiched between and held in close contact with the wires 2 drawn out from the wire draw-out surface 15 and the shield member 20, and the shield member 20 includes the water stop holding portion 22 for holding the second water stop member 40 between the water stop holding portion 22 and the wire draw-out surface 15.

According to this configuration, water is stopped between the housing 10 and the shield member 20 by the first water stop member 30 and between the wires 2 and the shield member 20 by the second water stop member 40, whereby the wire draw-out surface 15 of the housing 10 is located within the water stop region. Thus, the intrusion of water and the like into the housing 10 can be prevented. Further, since the second water stop member 40 is held between the wire draw-out surface 15 and the water stop holding portion 22 of the shield member 20, it is not necessary to separately provide a member for holding the second water stop member 40 and the connector 1 can be reduced in size accordingly.

Further, the plurality of wires 2L, 2R are drawn out from the wire draw-out surface 15, the second water stop member 40 includes the plurality of through holes 43L, 43R into each of which one of the plurality of wires 2L, 2R is inserted, and the water stop holding portion 22 includes the collective holding portion 22A disposed to collectively surround the plurality of wires 2L, 2R and the inter-wire holding portion 22B disposed between the plurality of wires 2L, 2R.

In a configuration in which the second water stop member 40 is held between the wire draw-out surface 15 and the collective holding portion 22A, if the second water stop member 40 is pressed by the collective holding portion 22A, a part between the plurality of wires 2L, 2R tends to be deformed to escape from a pressing force and protrude out from a proper position. According to the above configuration, since the second water stop member 40 is held also between the wire draw-out surface 15 and the inter-wire holding portion 22B, the second water stop member can be held at the proper position.

Further, the wires 2 and the housing 10 are integrally formed by insert molding.

If the wires 2 and the housing 10 are integrally formed by insert molding, clearances between the wires 2 and the housing 10 allow the intrusion of water and the like. Since the wire draw-out surface 15 is disposed in the water stop region according to the above configuration, the intrusion of water and the like through the clearance between the wires 2 and the housing 10 can be prevented.

Other Embodiments

The technique disclosed in this specification is not limited to the above described and illustrated embodiment and can be, for example, embodied as follows.

(1) Although the plurality of wires 2L, 2R are drawn out from the wire draw-out surface 15 in the above embodiment, the number of the wires is not limited to this and only one or three or more wires may be drawn out.

(2) Although the wire draw-out surface 15 of the housing 10 and the second water stop member 40 are disposed to face each other in the above embodiment, a wire draw-out surface and a second water stop member may not necessarily face each other. For example, another member may be disposed between the wire draw-out surface and the second water stop member.

(3) Although the second water stop member 40 and the water stop holding portion 22 are disposed to face each other in the above embodiment, a second water stop member and a water stop holding portion may not necessarily face each other. For example, another member may be disposed between the water stop holding portion and the second water stop member.

(4) Although the shield bracket 20 is fixed to the housing 10 in the above embodiment, a fixing destination of a shield bracket is not limited to this. For example, the shield bracket may be fixed to a casing of a device on which a connector is mounted.

(5) Although the wires 2 are disposed in the housing 10 by insert molding in the above embodiment, a wire inserting portion may be provided with through holes in advance and wires may be inserted into these through holes.

(6) Although the wire draw-out portion 12 of the housing 10 is shaped to project rearward in the above embodiment, the shape of a wire draw-out portion is not limited to this. For example, a wire draw-out surface may be provided to be flush with the rear surfaces of mounting receiving portions. In that case, a first water stop member may be sandwiched between mounting portions of a shield bracket and the mounting receiving portions.

The invention claimed is:

1. A connector comprising:

a wire;

a housing having a wire draw-out surface, the wire being drawn out from the wire draw-out surface, the housing includes a groove recessed in a circumferential direction into the housing;

a shield disposed outside the housing;

a first water stop sandwiched between and held in contact with the housing and the shield; and a second water stop sandwiched between and held in contact with the wire drawn out from the wire draw-out surface and the shield, the shield including a water stop holder that holds the second water stop between the wire draw-out surface and the water stop holder, the first water stop being located within the groove such that an axial face of the first water stop directly faces an inner side of the groove and an axial face of the second water stop directly faces an outer side of the groove in an axial direction.

2. The connector of claim 1, wherein:

the wire includes a plurality of wires that are drawn out from the wire draw-out surface, the second water stop includes a plurality of through holes, one wire of the plurality of wires being respectively inserted into each of the plurality of through holes, and the water stop holder includes a collective holder disposed to collectively surround the plurality of wires and an inter-wire holder disposed between respective wires of the plurality of wires.

3. The connector of claim 1, wherein the wire and the housing are integrally formed by insert molding.

* * * * *